US006702861B2

(12) United States Patent
Trask et al.

(10) Patent No.: US 6,702,861 B2
(45) Date of Patent: Mar. 9, 2004

(54) PROCESS FOR ANTIQUING FABRIC

(75) Inventors: Stanley Trask, Philadelphia, PA (US); Tibor Egervary, Wescosville, PA (US)

(73) Assignee: Valley Forge, Womelsdorf, PA (US)

( * ) Notice: Subject to any disclaimer, the term of this patent is extended or adjusted under 35 U.S.C. 154(b) by 0 days.

(21) Appl. No.: 10/124,484

(22) Filed: Apr. 18, 2002

(65) Prior Publication Data

US 2003/0196276 A1 Oct. 23, 2003

(51) Int. Cl.[7] ..... C11D 3/386; D06M 13/325

(52) U.S. Cl. ..... 8/114; 8/115.6; 8/557; 8/587

(58) Field of Search ..... 8/114, 115.6, 557, 8/587

(56) References Cited

U.S. PATENT DOCUMENTS 5,152,802 A * 10/1992 Berger et al. ..... 8/587
5,207,802 A * 5/1993 Baumann ..... 8/557
5,653,770 A * 8/1997 Goldstein et al. ..... 8/114
6,077,316 A * 6/2000 Lund et al. ..... 8/115.6

* cited by examiner

*Primary Examiner*—Yogendra N. Gupta
*Assistant Examiner*—Eisa Elhilo
(74) *Attorney, Agent, or Firm*—Blank Rome LLP

(57) ABSTRACT

A process for antiquing fabric and fabrics produced are disclosed. The process achieves a worn, distressed, and faded look to the fabric. The process may be used for creating fabrics having an antiqued, worn or weathered look. In the process, the fabric is treated with a dispersant leveling agent, the treated fabric is dyed and the dyed fabric is rinsed with a softener. The fabric may be bagged during the process to assist in achieving the antiqued look.

22 Claims, No Drawings

PROCESS FOR ANTIQUING FABRIC

FIELD OF THE INVENTION

The present invention relates to a process for antiquing fabric. Particularly, the process is appropriate for imparting a worn, distressed, and faded look to the fabric.

BACKGROUND OF THE INVENTION

A worn, distressed, and faded look in fabric has gained great popularity in today's market for apparel, upholstery, flags, banners, home furnishing, etc. This is especially true for denim base cotton fabric which is often treated to produce a stonewashed look. During treatment, the fabric is usually subjected to mechanical and/or chemical action to produce a worn, distressed, and faded look. The process used to achieve such a look or appearance is referred to herein as antiquing.

U.S. Pat. No. 4,740,213 to Ricci discloses a method of producing a random faded effect on fabrics where pumice is impregnated with a bleaching agent such as sodium hypochlorite. These granules are tumbled with the fabric to be treated in a rotating drum (not in a liquid bath) for a set period of time, and then the oxidizing agent is neutralized by washing the garments. The method produces the look sometimes called "acid wash" or "stonewash."

U.S. Pat. No. 5,558,676 to Gray et al. discloses a method of treating garments to produce a faded or distressed look using a gel composition comprising an oxidizing agent and a gelling agent. The gel composition is used to tumble with the fabric, during which tumbling the gel is smeared, by the random collisions of the garments with each other and the walls of the tumbler, and/or with a spreading agent, onto the garments. Where the gel contacts the garment, a degree of oxidizing or dye removal occurs.

U.S. Pat. No. 5,538,515 to Kafry et al. discloses a method of randomly fading fabric. The method comprises providing a wet fabric along with one or more hammering body having an external surface with a plurality of protrusions, and a powder comprising a bleaching agent to a tumbling chamber. The fabric, hammering body, and bleaching agent are tumbled in the chamber such that the protrusions of the hammering body repeatedly strike the fabric, thereby driving the powder into the fabric until a desired fading effect is achieved. After tumbling, the faded fabric is separated from the hammering body.

A worn looking fabric can also be prepared by sandblasting. For example, U.S. Pat. No. 5,505,739 to Montesano discloses a method for creating an overall worn look with specific areas of heavy wear. In the method, the fabric to be treated is placed onto a flat surface with the surface of the fabric to be treated exposed. The areas of the fabric in which heavy wear is desired, are sandblasted until the amount of wear in that area is achieved. The second step for creating an overall worn look of the garment is a stone-wash process in which the entire fabric is treated so that it fades and additional random worn marks are created to give the garment an overall worn look.

Chemical means without using abrasives to achieve the same or similar results have also been used. For example, U.S. Pat. No. 5,006,124 to Tieckelmann et al. discloses a process for wet processing of denim fabric. The process involves contacting the fabric with potassium permanganate to oxidize the coloring agent, neutralizing the oxidized denim fabric, and bleaching the fabric. The neutralization step involves (i) immersing the denim fabric in about 5 to 20 parts by weight of a first aqueous solution per part by weight denim fabric, (ii) maintaining said first aqueous solution between pH 3.0 and 6.0, (iii) subsequently incorporating about 2 parts by weight of either a monodentate or multidentate carboxylic acid chelating agent or salt or combination thereof, and 1 part by weight hydrogen peroxide, and (iv) maintaining said first aqueous solution at about 65° C. to 90° C. for 5 to 15 minutes. The bleaching step involves contacting the denim fabric for 4 to 8 minutes at 65° C. to 90° C. with 5 to 20 parts by weight of an alkaline bleaching solution comprising from about 0.6 to about 4 parts by weight hydrogen peroxide and sufficient alkali to provide a pH of about 8 to 9.

U.S. Pat. No. 5,006,126 to Olson et al. discloses the use of cellulase to degrade or partially degrade the cellulosic fabric and release dye from the fabric to achieve the stonewashed appearance.

The prior art has heretofore been primarily concerned with producing a stonewashed appearance in denim fabrics. There remains a need for a chemical antiquing process that is devoid of mechanical abrasion of the fabric and that is suitable for a variety of fabric including cotton, rayon, nylon, polyester, acrylic, etc.

SUMMARY OF THE INVENTION

The object of the present invention is to provide a method for antiquing fabric that is devoid of mechanical abrasion and suitable for a variety of fabric including cotton, rayon, nylon, polyester, acrylic, etc.

The method comprises the steps of a) treating the fabric with a dispersant leveling agent comprising anionic sulfonate;

b) dyeing the treated fabric; and c) rinsing the dyed fabric with a softener.

The chemical treatment step (step a) may further comprise the following steps performed in a suitable apparatus so that heating and/or agitating may be effected:

i) adding a first amount of a dispersant leveling agent comprising anionic sulfonate to the apparatus;

ii) adding salt to the apparatus;

iii) adding the fabric into the apparatus; and iv) heating the first amount of the dispersant leveling agent comprising anionic sulfonate, the salt and the fabric to a temperature of about 140° F. to about 150° F.;

The dyeing step (step b) may further comprise the following steps performed in a suitable apparatus so that heating, cooling and/or agitating and draining may be effected:

i) adding a first amount of dye to the apparatus;

ii) heating the contents of the apparatus (the first amount of the dispersant leveling agent comprising anionic sulfonate, the salt and the fabric) to a boil;

iii) adding a second amount of a dispersant leveling agent comprising anionic sulfonate to the apparatus;

iv) adding a second amount of dye to the apparatus;

v) agitating the contents (the first and second amounts of dispersant leveling agent and dye, the salt and the fabric) of the apparatus;

vi) heating the contents of the apparatus to a boil;

vii) cooling the contents of the apparatus to about 140° F.; and viii) draining the apparatus.

DETAILED DESCRIPTION OF THE INVENTION

The method of the present invention can be performed in a drum machine, a paddle machine, a vat, or a rotary tub. Preferably the machine (or apparatus) is tailored to the amount and type of fabric being treated. The apparatus generally comprises a stainless steel tank sized to optimally contain and to dye a predetermined amount of fabric and chemicals. Further, the apparatus also has means for heating and means for churning or agitating the content of the tank. The means for churning or agitating can include, but is not limited to, paddles, baffles, mechanical rotation, and/or combinations thereof. The means for heating can be, but are not limited to, steam, hot water, an electrical heating element, etc. For the present application, machines for agitation generally used in fabric dying are appropriate.

A dispersant leveling agent comprising one or more anionic sulfonate(s) is added to the apparatus. In embodiments of the invention, salt is also added to the apparatus and mixed well with the dispersant leveling agent, preferably before the addition of the fabric. Chemical ST (Leatex Chemical Co. Philadelphia, Pa.) is a preferred dispersant leveling agent. Water is used as a diluent or solvent for the dispersant leveling agent and preferably is about 10:1 parts by weight water:fabric, although the water:fabric ratio may vary in the range of from 8:1 to 15:1. A first amount of dispersant leveling agent is preferably added to the apparatus before the fabric in an amount of about 2% by weight based on the weight of the fabric. For example, if the weight of the fabric to be treated is 100 lbs, 2 lbs of dispersant leveling agent would be added to the apparatus. Although 2% is preferred, in general, the amount of dispersant leveling agent in the first amount can be from about 1% to about 3%. The purpose of the dispersant leveling agent is to prepare the fabric to accept the subsequent addition of the dye in such a way as to produce the antique look. A dispersant leveling agent comprising one or more anionic sulfonate(s) in accordance with the invention functions both as dispersant and a surfactant/detergent. The dispersant leveling agent may comprise one anionic sulfonate to perform both dispersant and surfactant/detergent functions or the dispersant leveling agent may comprise more than one anionic sulfonate to perform both dispersant and surfactant/detergent functions.

Any number of available anionic sulfonates may be used in the dispersant leveling agent, so long as both dispersant and surfactant/detergent functions are performed. Anionic sulfonates include the salts of $C_5$–$C_{20}$ linear alkylbenzene sulfonates, alkyl ester sulfonates, $C_6$–$C_{22}$ primary or secondary alkane sulfonates, $C_6$–$C_{24}$ olefin sulfonates, sulfonated polycarboxylic acids, alkyl glycerol sulfonates, fatty acyl glycerol sulfonates, fatty oleyl glycerol sulfonates, and any mixtures thereof.

The salt appropriate for the present invention can be, but is not limited to, sodium chloride. Sodium sulfate (Glauber's salt) may also be used. Preferably, the salt is added in an amount of about 20% by weight based on the weight of the fabric. For example, if the weight of the fabric to be treated is 100 lbs, 20 lbs of salt would be added to the apparatus. Although 20% is preferred, in general, the amount of salt can be from about 10% to about 30%.

After the Chemical ST and salt are well mixed and dissolved, the fabric is loaded into the apparatus. The fabric is preferably contained in polyester mesh bag. The weight of fabric per bag is on the order of 10 to 30 pounds of fabric per bag, depending upon the size of the bag. Twenty pounds of fabric per bag is preferred, and the bags are randomly stuffed with fabric with no loose areas from the top of the bag to bottom.

After the Chemical ST, salt, and fabric are added to the apparatus, the content is heated to about 140° F. to 150° F., more preferably about 145° F.

After heating, a first amount of dye is added. The dyes are preferably brown, yellow, blue, and/or combination thereof. Other colors can be used depending of the desired effect. The dyes can be, but is not limited to, direct dye, pre-metallized acid dye, high-temperature dispersed dye, and cationic dye. The dyes are preferably matched with the type of fabric. For example, the dye for rayon or cotton is preferably direct dye; the dye for nylon is preferably pre-metallized acid dye; the dye for polyester is high-temperature dispersed dye; and the dye for acrylic is cationic dye. Further, the dye can be added simultaneously or one after another. For a mottled look, the dyes are preferably added sequentially one after another.

In a particular instance, flags with an antique appearance were prepared using a dye with (per 100 pounds of flag material) 1.39 ounces of solophenyl brown AGL (Ciba Geigy), 320 grains dyerite yellow 4GL (200%) (Reich Chemical), and 227 grains of Intralite Brilliant Blue 2GLL (Reich Chemical). Different color formulations can be used for different effects, green may be emphasized to produce a moldy effect, gray may be used predominantly to produce a weathered affect, etc. The dye/fabric weight percentages may be on the order of 0.05% to 4.0% dye to fabric, or more preferably 0.1% to 1.0%.

The contents of the apparatus are then boiled as soon as the dyes have been added. By boiling, it is meant that the content of the apparatus is heated to a temperature of from about 210° F. to about 212° F. for 10 to 15 minutes.

Once boiling temperature is achieved and maintained, a second amount of Chemical ST and a second amount of dyes are added to the apparatus. Preferably, this second amount of Chemical ST is about 1% by weight based on the weight of the fabric. Although 1% is preferred, in general, the second amount of Chemical ST can be from about 0.5% to about 2%. In any event, the preferred split for the first and second amount of dyes and Chemical ST is 50/50, i.e., the amount of the second amount of dye is preferably the same as that of the first amount of dye and the same is true for the Chemical ST. Also in this step, the dye can be added simultaneously or one after another. For a mottled look, the dyes are preferably added sequentially one after another. The time required for this step is essentially only that required for the addition of the materials to the apparatus.

Once all of the dye has been added, the contents of the apparatus is agitated or churned for about 3 to 10 minutes, preferably about 5 minutes. The speed of agitation is from about 10 to 30 rpm, preferably about 20 rpm.

After about 5 minutes, the agitation cycle is stopped and the contents of the apparatus is boiled for about 30 minutes. Although 30 minutes is preferred, the boiling can be from about 15 to about 45 minutes.

After boiling, the contents of the apparatus is cooled to about 140° F. Although 140° F. is preferred, the temperature can be from about 130° F. to about 150° F. The cooling process can be accomplished by a variety of methods, such as cooling coil, direct addition of cold water, convective cooling, or combination thereof. This is not an exhaustive list, however, and other methods of cooling known in the art can be used with the present invention.

After cooling, the liquid content of the apparatus is drained. The remaining wet fabric is then rinsed with water and a softener is added, for about 5 minutes to about 10 minutes, preferably about 6 minutes to about 9 minutes, and most preferably about 8 minutes. The temperature of this portion of the process may be from about 100° F. to about 120° F. The softener can be any cationic softener or mixture thereof. A fatty amide softener is preferred. The softener may also contain some silicone. The amount of softener is from about 1.0% to 3.0 weight percent softener to fabric, preferably about 1.5%. Softener ST available from Leatex Chemical (Philadelphia, Pa.) is preferred.

After rinsing, the wet fabric can be tumble dried in a commercial drier. Other methods of drying fabric known in the art are also appropriate for the present invention.

The invention has been disclosed broadly and illustrated in reference to representative embodiments described above. Those skilled in the art will recognize that various modifications can be made to the present invention without departing from the spirit and scope thereof.

What is claimed is:

1. A process for antiquing fabric comprising the steps of:

a) treating the fabric with a dispersant leveling agent comprising anionic sulfonate;

b) dyeing the treated fabric; and c) rinsing the dyed fabric with a softener wherein step b) further comprises the steps of:

i) adding a first amount of dye to an apparatus;

ii) heating the contents of the apparatus to a boil;

iii) adding a second amount of a dispersant leveling agent to the apparatus;

iv) adding a second amount of dye to the apparatus;

v) agitating the contents of the apparatus;

vi) heating the contents of the apparatus to a boil;

vii) cooling the contents of the apparatus to about 140° F.; and viii) draining the apparatus.

2. The process of claim 1, wherein step a) further comprises the steps of;

i) adding a first amount of dispersant leveling agent to an apparatus;

ii) adding salt to the apparatus;

iii) loading the fabric into the apparatus; and iv) heating the fabric, salt and dispersant leveling agent to about 140° F.–150° F.

3. A process for antiquing fabric comprising the sequential steps of:

a) adding a first amount of a dispersant leveling agent to an apparatus;

b) adding salt to the apparatus;

c) loading the fabric into the apparatus; and d) heating the apparatus from about 140° F. to about 150° F.;

e) adding a first amount of dye to the apparatus;

f) heating the contents of the apparatus to a boil;

g) adding a second amount of the dispersant leveling agent to the apparatus;

h) adding a second amount of dye to the apparatus;

i) agitating the contents of the apparatus;

j) heating the contents of the apparatus to a boil;

k) cooling the contents of the apparatus to about 140° F.;

l) draining the apparatus; and m) rinsing the fabric with a softener.

4. The process of claim 3, further comprising drying the fabric.

5. The process of claim 3, wherein the first amount of the dispersant leveling agent in step b) is about 2% by weight based on the weight of the fabric.

6. The process of claim 3, wherein the salt in step c) is about 20% by weight based on the weight of the fabric.

7. The process of claim 3, wherein the heating in step e) occurs for about 5 to about 10 minutes.

8. The process of claim 3, the first amount of dye in step f) is from about ⅜% to about 2% by weight based on the weight of the fabric.

9. The process of claim 3, wherein the second amount of the dispersant leveling agent in step h) is about 1% by weight based on the weight of the fabric.

10. The process of claim 3, wherein the second amount of dye in step i) is from about ⅜% to about 2% by weight based on the weight of the fabric.

11. The process of claim 3, wherein in step j) the apparatus runs for about 5 minutes.

12. The process of claim 3, wherein the contents of the apparatus in step l) boils for about 30 minutes.

13. The process of claim 3, wherein the softener in step o) is about 1.5% by weight based on the weight of the fabric.

14. The process of claim 3, wherein the first amount of dye and the second amount of dye are selected from the group consisting of direct dye, pre-metallized dye, high-temperature dispersed dye, and cationic dye.

15. The process of claim 3, wherein the first amount of dye and the second amount of dye comprise brown dye, yellow dye, blue dye, or combination thereof.

16. The process of claim 15, wherein the brown, yellow, and blue dyes are added one right after the other.

17. The process of claim 3, wherein the softener is a fatty amide softener.

18. The process of claim 3, wherein the salt in step c) is sodium chloride or sodium sulfate or mixtures thereof.

19. The process of claim 1, wherein the fabric is contained in a mesh bag.

20. The process of claim 3, wherein the fabric is contained in a mesh bag.

21. The process of claim 3, wherein the heating and agitating apparatus is selected from the group consisting of a drum machine, a paddle machine, a vat and a rotary tub.

22. A dyed fabric made in accordance with the process of claim 19.

* * * * *